US010800581B2

(12) United States Patent
Berroa Garcia

(10) Patent No.: US 10,800,581 B2
(45) Date of Patent: Oct. 13, 2020

(54) STOPPER FOR CONTAINERS

(71) Applicants: BETAPACK, S.A.U., Irun (Guipuzcoa) (ES); ALMA SA, La Ferriere Bochard (FR)

(72) Inventor: Javier Berroa Garcia, Irun (ES)

(73) Assignees: BETAPACK, S.A.U., Irun (Guipuzcoa) (ES); ALMA SA, La Ferriere Bochard (FR)

( * ) Notice: Subject to any disclaimer, the term of this patent is extended or adjusted under 35 U.S.C. 154(b) by 314 days.

(21) Appl. No.: 15/829,643

(22) Filed: Dec. 1, 2017

(65) Prior Publication Data

US 2018/0086510 A1 Mar. 29, 2018

Related U.S. Application Data

(63) Continuation-in-part of application No. PCT/ES2016/070140, filed on Mar. 4, 2016.

(51) Int. Cl.
*B65D 41/46* (2006.01)
*B65D 47/08* (2006.01)

(52) U.S. Cl.
CPC ..... *B65D 41/46* (2013.01); *B65D 47/08* (2013.01)

(58) Field of Classification Search
CPC .... B65D 41/46; B65D 47/08; B65D 47/0804; B65D 41/465; B65D 43/00; B65D 50/066
USPC ..... 215/237, 251; 220/835
See application file for complete search history.

(56) References Cited

U.S. PATENT DOCUMENTS

| | | | | |
|---|---|---|---|---|
| 4,533,058 | A | 8/1985 | Uhlig | |
| 4,826,026 | A * | 5/1989 | Gach | B65D 47/0885 215/206 |
| 5,040,691 | A * | 8/1991 | Hayes | B65D 50/061 215/216 |
| 5,875,907 | A * | 3/1999 | Lay | B65D 47/0804 215/250 |
| 9,309,029 | B2 * | 4/2016 | Incorvia | B29C 45/0081 |
| 2004/0245206 | A1 * | 12/2004 | Antier | B65D 41/485 215/235 |
| 2006/0011573 | A1 | 1/2006 | Herald et al. | |
| 2006/0201904 | A1 | 9/2006 | Comeau et al. | |

FOREIGN PATENT DOCUMENTS

| | | | |
|---|---|---|---|
| ES | 1066671 | U | 2/2008 |
| ES | 1076277 | U | 2/2012 |
| FR | 2851990 | A1 | 9/2004 |

* cited by examiner

*Primary Examiner* — Anthony D Stashick
*Assistant Examiner* — Raven Collins
(74) *Attorney, Agent, or Firm* — Hayes Soloway PC

(57) ABSTRACT

A cap (1) for containers, which comprises a cylindrical body formed by the articulated joint between two superimposed parts, a lower part (2) having gripping means for retention thereof on the neck (20) of the container, and an upper part (3) having an upper base (5) joined to a perimeter wall (7), wherein said perimeter wall (7) comprises a visor (9) for enabling the opening of the cap (1), wherein said visor (9) comprises a flap (10) disposed transversely thereto and in correspondence to a complementary cut-out (4) provided on the upper edge of the lower part (2), wherein said flap (10) comprises, on an inner surface, a cord (11) disposed transversely to the axial axis of the cap (1) for executing the grip of the upper part (3) to the neck (20) of the container.

19 Claims, 5 Drawing Sheets

STOPPER FOR CONTAINERS

CROSS REFERENCE TO RELATED APPLICATION AND PRIORITY

This application is a Continuation-in-Part of PCT/ES2016/070140 filed Mar. 4, 2016, entitled, "Stopper for Containers", the entire disclosures of which are incorporated herein by reference.

OBJECT OF THE INVENTION

The present invention belongs to the field of closing elements for containers and, more specifically, to caps for containers of the type comprising two articulated parts, a lower part or base and an upper part, cap or lid, which can be removed and replaced a plurality of times for discreetly dispensing the content of the container wherein it is disposed.

One object of the invention consists of providing a cap for containers that is capable of improving the grip of the upper part to the neck of the container.

Likewise, an object of the invention is to provide a cap for containers capable of facilitating bottling and/or capping in the manufacture of containers.

Likewise, an object of the invention is to provide a cap for containers capable of guaranteeing the inviolability of the cap.

Lastly, an object of the invention is to provide a cap for containers capable of improving closure with the neck of the container for reducing the entrance of dust and/or foreign matter in the interior of the cap.

BACKGROUND OF THE INVENTION

In the field of caps of containers, caps formed by the articulation of two parts are known, a lower part having appropriate means for coupling to the neck of the bottle and complemented by an upper part, cap or lid, which occupies a closure or opening position, allowing a user to drink the liquid contained in the container without having to remove the cap.

These types of caps have several drawbacks. Namely inter alia, on many occasions, closure is inadequate, as these caps lack means which indicate that the cap is properly closed, i.e. that it has reached the closed position. Likewise, due to their configuration and deformations resulting from their use, after a relatively short period of time the cap gives rise to leaks.

Therefore, in the state of the art it is desirable to improve these types of caps in order to provide caps for containers capable of ensuring a proper, reliable and long-lasting closure.

DESCRIPTION OF THE INVENTION

Therefore, the cap for containers proposed by the present invention is presented as an improvement with respect to the state of the art, as it satisfactorily achieves the aforementioned objectives indicated as ideal for the art.

The invention consists of a cap for containers that comprises a cylindrical body formed by the articulated joint between two superimposed parts, a lower part having gripping means for retention thereof on the neck of the container and an upper part having an upper base joined to a perimeter wall, wherein said perimeter wall comprises a visor for enabling the opening of the cap. The visor comprises a flap disposed on its lower face, transversely to said visor and in correspondence with a complementary cut-out provided on the lower edge of the lower part. The flap comprises a cord disposed transversely to the axial axis of the cap for executing the grip of the upper part to the neck of the container.

Therefore, the cap proposed by the invention incorporates a flap, transverse to the visor provided in the upper part, wherein said flap incorporates on its inner surface a cord transverse to the axial axis of the cap for executing the grip of the upper part to the neck of the container.

Thus, the cap incorporates a cord or rounded perimeter rib on the inner surface of the flap, which is complementary to the neck ring, such that the cord of the cap and the neck ring must jump one on top of the other, in a closed situation, producing a certain "click" effect. This "click" informs the user that closure has taken place and ensures the maintainability and tightness thereof.

In a preferred embodiment, the perimeter wall of the upper part comprises two pairs of vertical slots made parallel to the axial axis of the cap, so as to define the formation of two joining strips between the lower part and the upper part. This embodiment offers a long-lasting articulation of parts, capable of allowing the closure/opening of the upper part by bending/tensioning the strips, which form part of the perimeter wall of the upper part.

Preferably, the lower part comprises a ridge disposed between the strips.

Preferably, the strips comprise, on their inner surface, a first perimeter relief that reduces the inner diameter of the cap. In this manner, the invention prevents the entrance of dust in the interior of the container.

Likewise, preferably, the ridge disposed between the strips comprises, on its inner face, a second perimeter relief that reduces the inner diameter of the cap. In this manner, the invention prevents the entrance of dust in the interior of the container.

In another preferred embodiment, the upper part comprises two recesses provided on the outer edge of its upper base, whereon corresponding perimeter slots made around the perimeter in said recesses and defining a joining tab with each of the strips are provided, and wherein said tabs are dimensioned for providing a continuous perimeter edge on the upper base. In this manner, the invention makes it possible to maintain a constant diameter on the upper base of the cap and, thus, be able to centre the cap on the capping heads, thereby facilitating the manufacture of containers.

Preferably, the upper part comprises a protrusion between the two recesses which enables the cap to be opened more than 180°. Said protrusion serves as a swivel point of the articulation. Additionally, said protrusion will cause a "click" with the ridge, which will inform the consumer that he or she has opened the cap properly.

In another preferred embodiment, the ridge disposed between the strips comprises at least one rib joined in a frangible manner to the upper part before opening the cap. Therefore, the invention includes means that guarantee the seal and inviolability of the cap, in a manner easily visible to the user.

In another preferred embodiment, the upper base has a greater diameter than the perimeter wall of the upper part. Thus, the upper part defines a rim in the joint between the perimeter wall and the upper base, so as to allow the use of mechanical cones for capping on small caps. Mechanical cones are cheaper and simpler than vacuum cones, conventionally used for capping on small caps. Additionally, as opposed to vacuum cones, mechanical cones do not require pneumatic installation in bottling lines, due to which the bottler may use them in any type of capping machine.

In another preferred embodiment, the lower part comprises on its inner face a third perimeter relief disposed on a plane below the cut-out and extending at least between the ends of said cut-out. This third perimeter relief is a retention relief or lip which makes it possible to keep the cap on the bottle when opened.

In another preferred embodiment, the upper part comprises a burr on the lower edge of the inner surface of its perimeter wall to come into contact with the neck of the container. In this manner, the invention avoids the entrance of dust and/or foreign matter in its interior, preventing them from coming into contact with the consumer's mouth.

In another preferred embodiment, the upper base comprises a cylindrical skirt that emerges from its inner face and is dimensioned for being inserted in the interior of the neck of the container. Thus, the invention provides means for closing the neck mouth to improve cap closure.

In another preferred embodiment, the upper part comprises at least one pair of ribs on the inner surface of its perimeter wall, wherein each rib is disposed on both sides of the flap. Thus, the invention improves cap tightness. Additionally, the ribs accentuate the cap closure "click" so that the consumer is aware that he or she has closed the cap properly.

DESCRIPTION OF THE DRAWINGS

As a complement to the description being made, and for the purpose of helping to make the characteristics of the invention more readily understandable, in accordance with a preferred practical embodiment thereof, said description is accompanied by a set of drawings constituting an integral part thereof which, by way of illustration and not limitation, represent the following.

PREFERRED EMBODIMENT OF THE INVENTION

Figure 1:
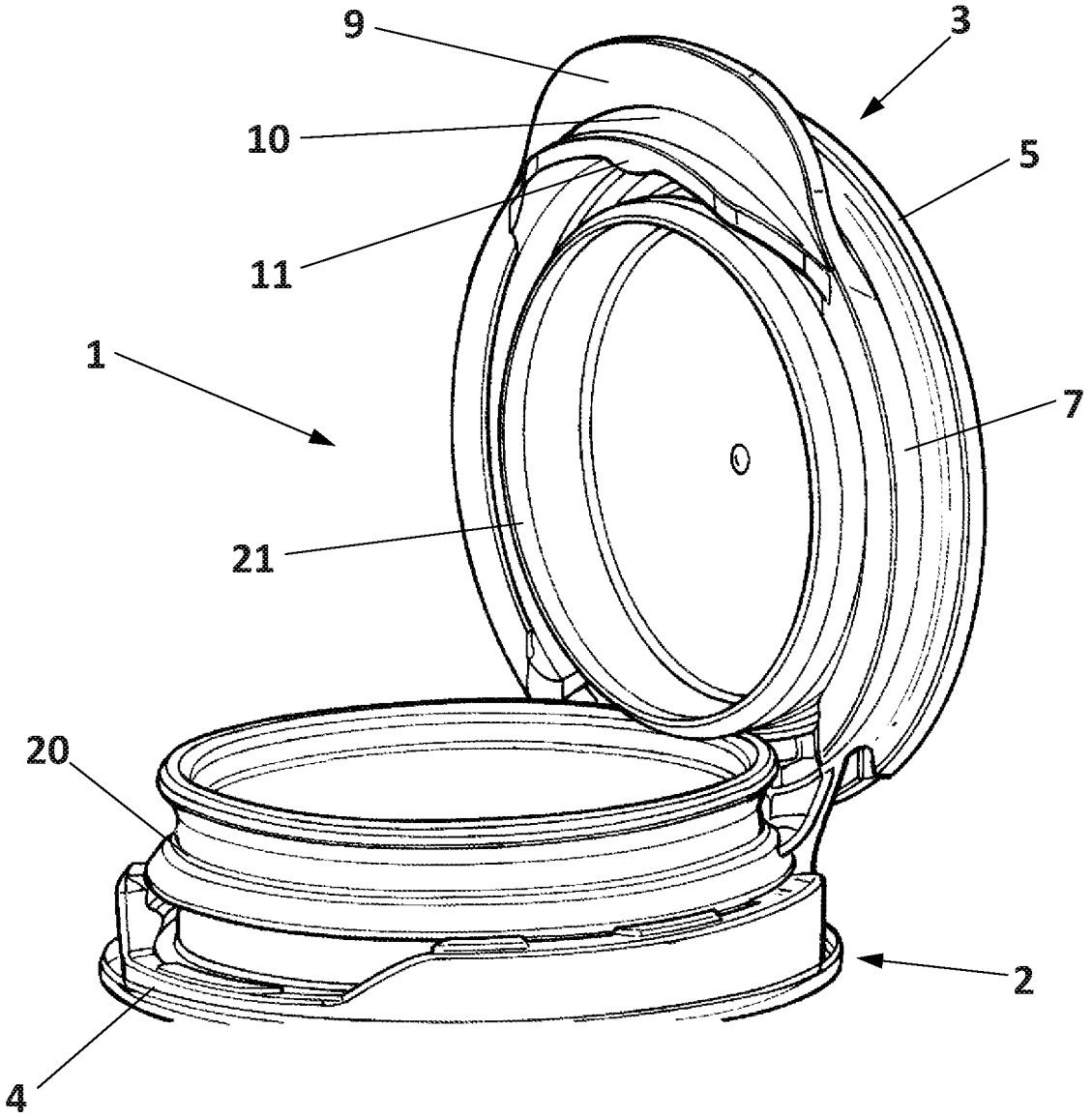
FIG. 1 shows a perspective view of a cap, according to an embodiment of the invention, provided on the neck of a container and in the open position.

FIG. 1 shows a cap 1 provided on the neck 20 of a container, in the open position.

The cap 1 is formed by the articulated joint between two superimposed parts, a lower part 2 and an upper part 3. The lower part 2 comprises gripping means for retention thereof on the neck 20 of the container, both during opening and closing of the cap 1. The upper part 3 comprises an upper base 5 joined to a perimeter wall 7. A transverse visor 9 is provided in said perimeter wall 7, capable of enabling the opening of the cap 1.

In accordance with the present invention, the visor 9 comprises a flap 10 transverse thereto and in correspondence with a complementary cut-out 4 provided on the upper edge of the lower part 2. Additionally, the flap 10 comprises, on the edge of its inner surface, a cord 11 disposed transversely to the axial axis of the cap 1 for executing the grip of the upper part 3 to the neck 20 of the container.

According to the described configuration, the cord 11 of the flap 10 goes over the ring of the neck 20 of the container in the closed position, constituting a "click" that indicates and stabilises said closed position.

Preferably, the upper base 5 may comprise a cylindrical skirt 21 that emerges from its inner face and is dimensioned for being inserted in the interior of the neck 20 of the container.

Figure 2:
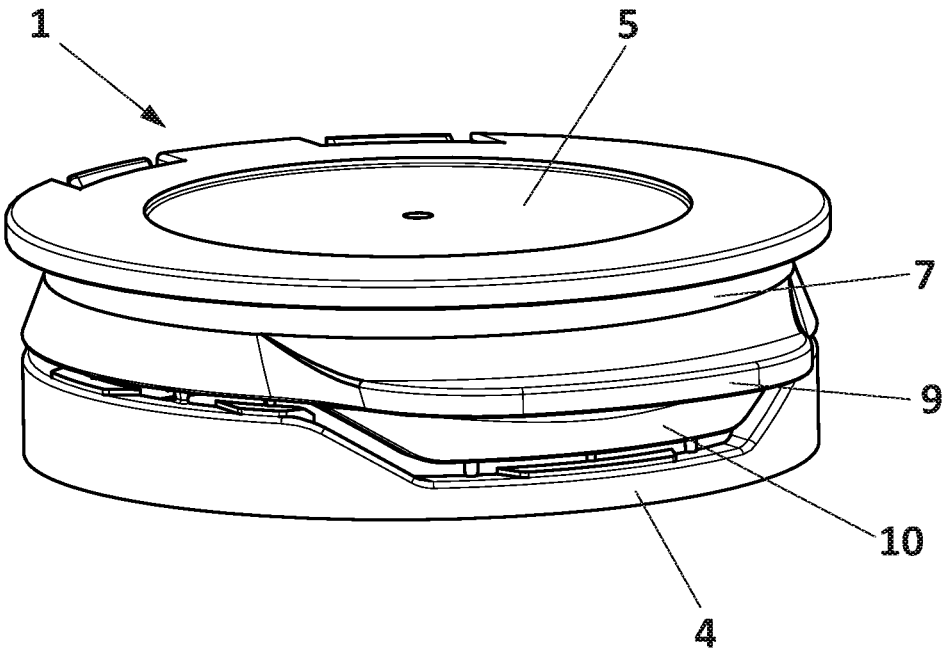
FIG. 2 shows a front view of the cap for containers in the closed position, according to an embodiment of the invention.

FIG. 2 shows a front view of the cap 1 in the closed position. As can be observed, said cap 1 consists of a substantially cylindrical body formed by the articulated joint between the lower part 2 and the upper part 3. Thus, the correspondence of the flap 10 of the upper part 3 with the cut-out 4 of the lower part 2 completes said cylindrical body of the cap 1.

According to a preferred embodiment and as shown in FIG. 2, the upper base 5 may have a diameter greater than the perimeter wall 7 of the upper part 3, such that said upper base 5 defines a rim which enables the use of mechanical cones in the capping stage. Thus, the positioning of the upper base 5 at the top end of the diametrical recess of said upper base 5 with respect to the perimeter wall 7, allows an industrial distribution of 80,000 bottles per hour in bottling lines.

Figure 3:
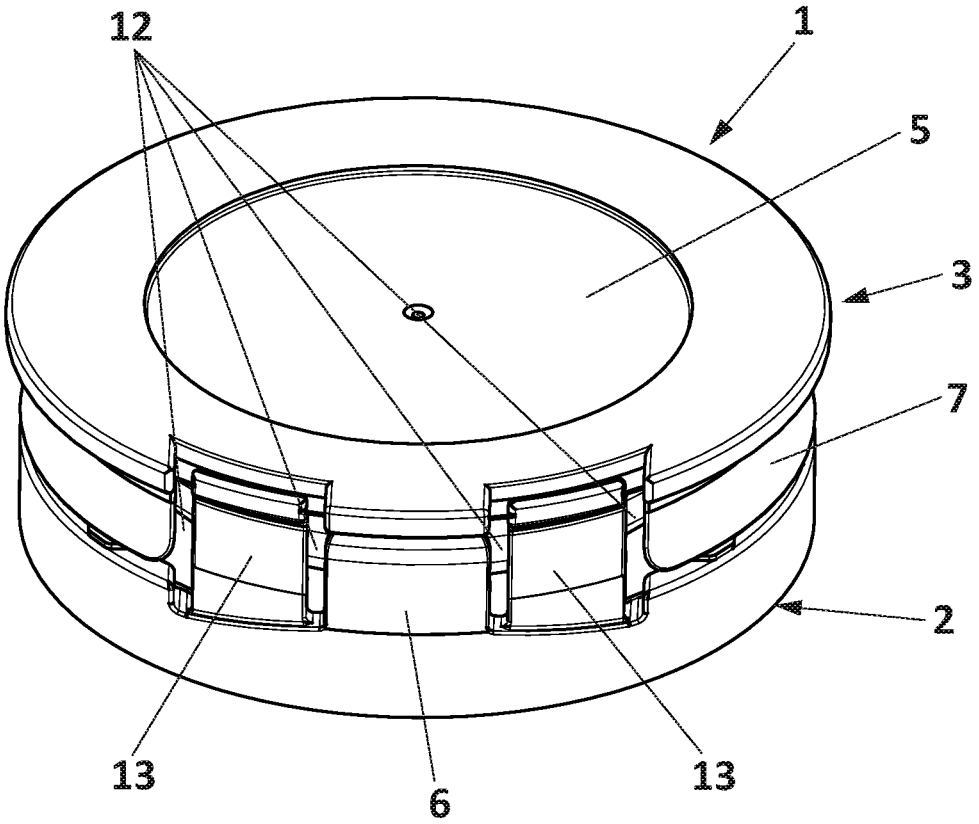
FIG. 3 shows a rear view of the cap for containers in the closed position, according to an embodiment of the invention.

FIG. 3 shows the rear part of the cap 1, wherein the upper 3 and lower 2 parts are articulated. As can be observed, two pairs of vertical slots 12 have been made in the perimeter wall 7, disposed parallel to the axial axis of the cap 1 and defining the formation of two joining strips 13 between the two parts 2, 3. Said strips 13 execute the articulation of the parts 2, 3.

As shown in FIG. 3, the lower part 2 may comprise a ridge 6 disposed between the strips 13.

Figure 4:
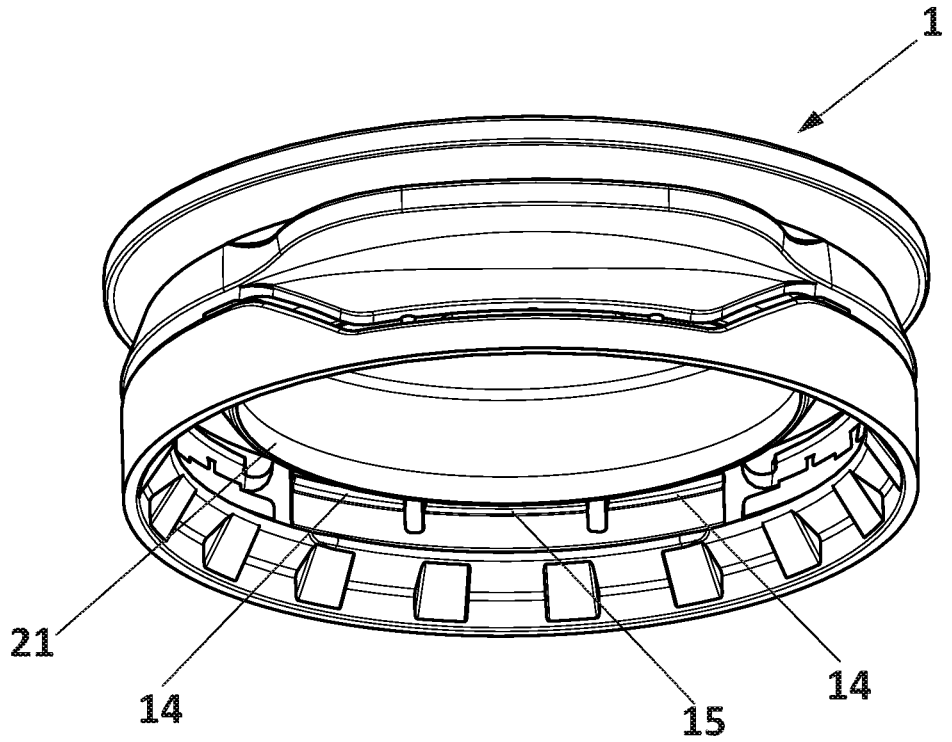
FIG. 4 shows a perspective view of the front part of the cap for containers in the closed position, according to an embodiment of the invention.

FIG. 4 shows the interior of the rear part of the cap 1. As can be observed, on their inner face, the strips 13 may include a first perimeter relief 14 that reduces the inner diameter of the cap 1. By reducing the interior area of the cap 1, dust is prevented from entering the interior of the container.

Likewise, as shown in FIG. 4, the ridge 6 may include a second perimeter relief 15 to reduce the inner diameter of the cap 1. Thus, the cap 1 reduces the inner area thereof, improving the closure of the container and, therefore, preventing dust from entering the interior thereof.

Figure 5:
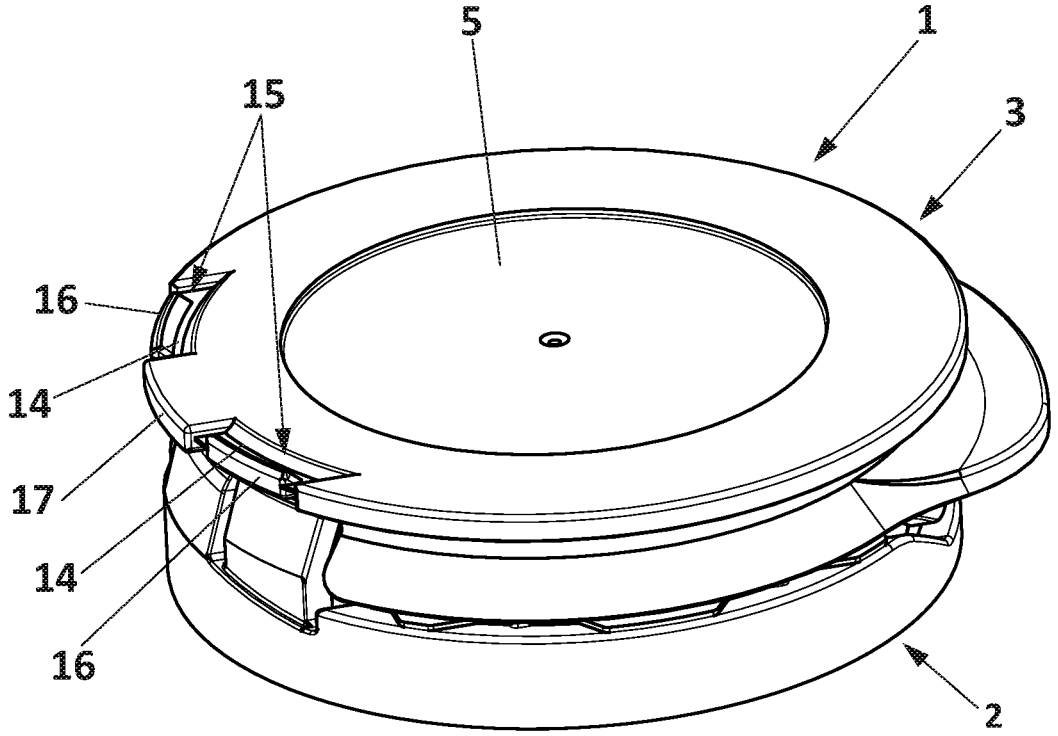
FIG. 5 shows a side view of the cap for containers in the closed position, according to an embodiment of the invention.

According to a preferred embodiment, and as shown in FIG. 5, the upper part 3 may comprise two recesses 15 provided on the outer edge of its upper base 5 and a pair of perimeter slots 14 in said recesses 15.

As can be observed, the perimeter slots 14 define the formation of a joining tab 16 with each of the strips 13, wherein said tabs 16 are dimensioned so as to provide a continuous perimeter edge on the upper base 5. By maintaining the diameter of the upper base 5 constant, the invention makes it possible to centre the cap 1 on the capping heads, thereby facilitating the manufacture of containers.

Likewise, as shown in FIG. 5, the upper part 3 may incorporate a protrusion 17 between the recesses 15 which allows the cap 1 to be opened more than 180°.

Figure 6:
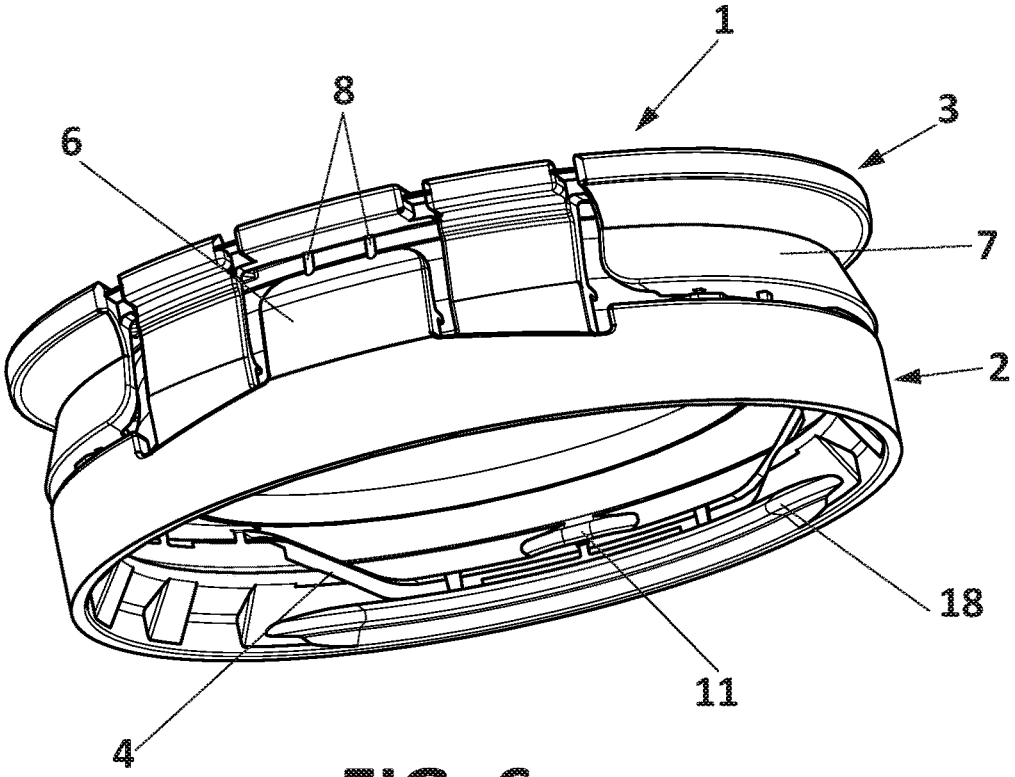
FIG. 6 shows a perspective view of the rear part of the cap for containers in the closed position, according to an embodiment of the invention.

FIG. 6 shows the interior of the front part of the cap 1. As can be observed, on the inner face, the lower part 2 may incorporate a third perimeter relief 18. Said third relief 18 is disposed on a plane below the cut-out 4 and extends, at least, between the ends of said cut-out 4.

According to a preferred embodiment, and as also shown in FIG. 6, the ridge 6 disposed between the strips 13 may comprise at least one rib 8 joined in a frangible manner to the upper part 3 before the opening of the cap 1. Thus, the invention provides proof of cap 1 inviolability in the articulation zone between the parts 2, 3, as once the cap is opened the rib 8 is broken, informing the user that the cap 1 has been opened.

Figure 7:
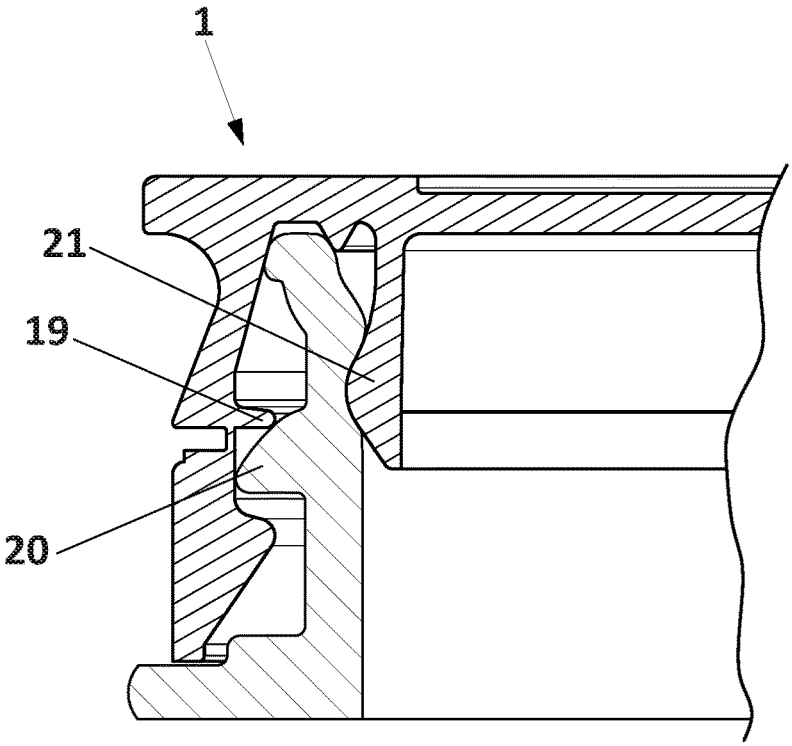
FIG. 7 show a transverse cross section of a cap, according to an embodiment of the invention, provided on the neck of a container and in the closed position.

FIG. 7 shows a transverse cross section of the cap 1. As can be observed, the upper part 3 comprises a burr 19 on the lower edge of the inner surface of its perimeter wall 7 for coming into contact with the neck 20 of the container. Thus, the invention limits the entrance of dust and/or foreign matter in the zones that are in contact with the consumer's mouth.

Figure 8:
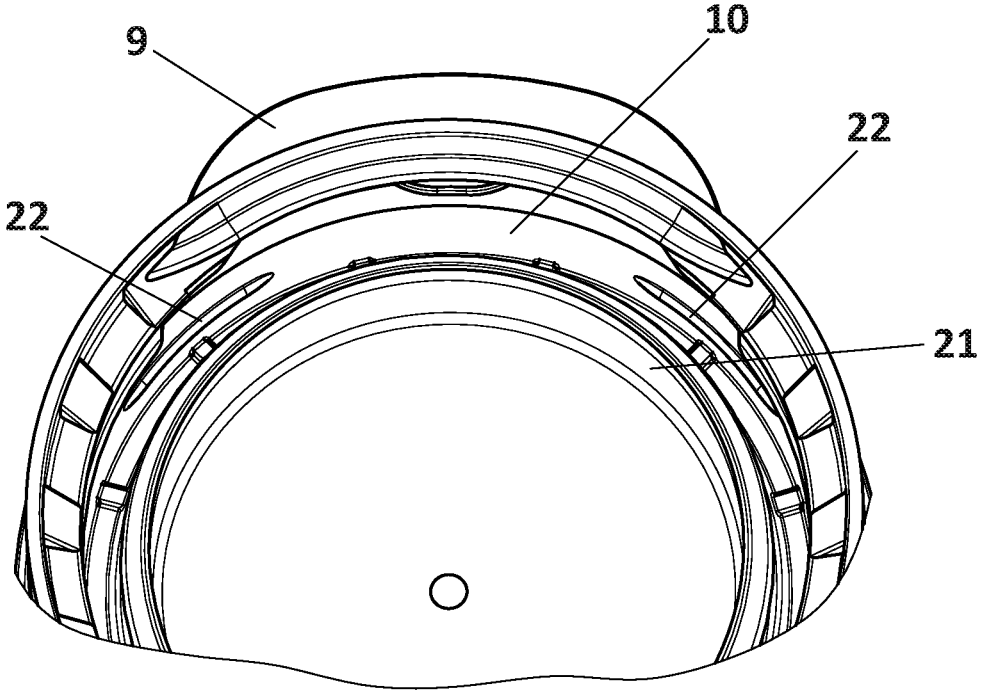
FIG. 8 shows a detailed view of a portion of the upper part of a cap, according to an embodiment of the invention.

FIG. 8 shows a detailed view of the interior of the upper part 3 of the cap 1. As can be observed, the inner surface of its perimeter wall 7 houses a pair of ribs 22. Each rib 22 is disposed on either side of the flap 10. Preferably, at least one part of each rib 22 is formed on the inner surface of the flap 10.

Figure 9:
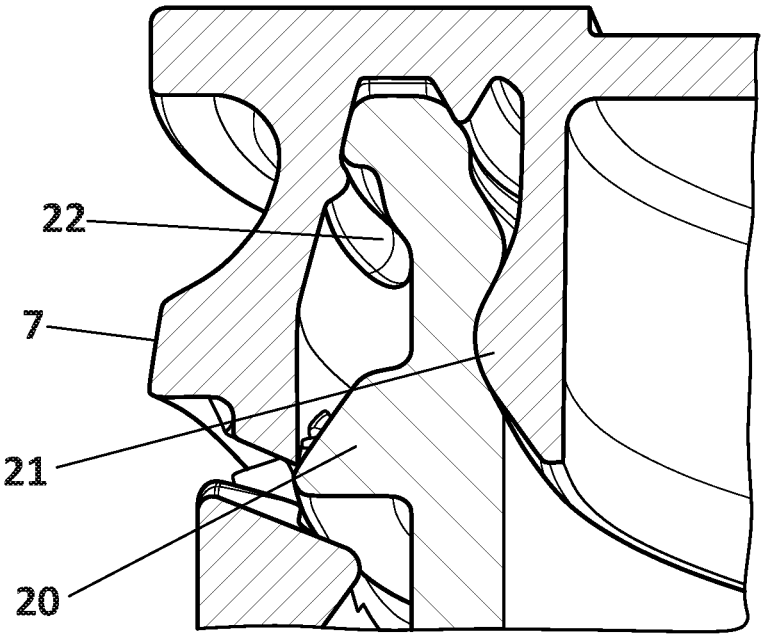
FIG. 9 shows a sectional view of a cap, according to an embodiment of the invention, provided on the neck of a container and in a closed position.

FIG. 9 shows a cross-section of a cap 1 wherein a portion of the ribs 22 shown in FIG. 8 can be observed. The ribs 22 improve cap 1 tightness, both before and after opening it. Likewise, they accentuate cap "click" closure.

Lastly, in light of this description and figures, the person skilled in the art may understand that the invention has been described according to some preferred embodiments thereof, but that multiple variations may be introduced in said preferred embodiments without detracting from the object of the invention as claimed.

The invention claimed is:

1. A cap for containers, which comprises a cylindrical body formed by the articulated joint between two superimposed parts, a lower part having a perimeter relief disposed on a plane below a cut-out and extends, at least, between the ends of said cut-out, and an upper part having an upper base joined to a perimeter wall, wherein said perimeter wall comprises a visor, wherein said visor comprises a flap disposed transversely thereto, in correspondence with the complementary cutout provided on the upper edge of the lower part, wherein said flap comprises a cord on an inner surface disposed transversely to the axial axis of the cap for executing the grip of the upper part to the neck of the container, wherein the perimeter wall of the upper part further comprises two pairs of vertical slots made parallel to the axial axis of the cap, defining the formation of two joining strips between the lower part and the upper part.

2. The cap for containers, according to claim 1, wherein the lower part comprises a ridge disposed between the strips.

3. The cap for containers, according to claim 1, wherein the strips comprise a first perimeter relief on their inner face that reduces the inner diameter of the cap.

4. The cap for containers, according to claim 2, wherein the ridge disposed between the strips comprises a second perimeter relief on its inner face that reduces the inner diameter of the cap.

5. The cap for containers, according to claim 1, wherein the upper part comprises two recesses provided on the outer edge of its upper base, whereon corresponding perimeter slots are provided, made around the perimeter in said recesses and defining a joining tab with each of the strips, and wherein said tabs are dimensioned to provide a continuous perimeter edge on the upper base.

6. The cap for containers, according to claim 5, wherein the upper part comprises a protrusion provided between the two recesses which enables the cap to be opened more than 180°.

7. The cap for containers, according to claim 2, wherein the ridge disposed between the strips comprises at least one rib joined in a frangible manner to the upper part before opening the cap.

8. The cap for containers, according to claim 1, wherein the upper base has a diameter greater than the perimeter wall of the upper part.

9. The cap for containers, according to claim 1, wherein the lower part comprises a third perimeter relief on its inner face disposed on a plane below the cut-out and extending at least between the ends of said cut-out.

10. A cap for containers, which comprises a cylindrical body formed by the articulated joint between two superimposed parts, a lower part having gripping means for retention thereof on the neck of the container, and an upper part having an upper base joined to a perimeter wall, wherein said perimeter wall comprises a visor, wherein said visor comprises a flap disposed transversely thereto, in correspondence with a complementary cut-out provided on the upper edge of the lower part, wherein said flap comprises a cord on an inner surface disposed transversely to the axial axis of the cap for executing the grip of the upper part to the neck of the container, wherein the upper part comprises a burr on the lower edge of the inner surface of its perimeter wall for coming into contact with the neck of the container.

11. The cap for containers, according to claim 1, wherein the upper base comprises a cylindrical skirt that emerges from its inner face and is dimensioned so as to be inserted in the interior of the neck of the container.

12. A cap for containers, which comprises a cylindrical body formed by the articulated joint between two superimposed parts, a lower part having gripping means for retention thereof on the neck of the container, and an upper part having an upper base joined to a perimeter wall, wherein said perimeter wall comprises a visor, wherein said visor comprises a flap disposed transversely thereto, in correspondence with a complementary cut-out provided on the upper edge of the lower part, wherein said flap comprises a cord on an inner surface disposed transversely to the axial axis of the cap for executing the grip of the upper part to the neck of the container, wherein the upper part further comprises at least one pair of ribs on the inner surface of its perimeter wall, wherein each rib is disposed on both sides of the flap.

13. The cap for containers according to claim 1, wherein the cord is releasably engageable with the neck such that the cord is reusable for repeated engagement and disengagement with the neck.

14. The cap for containers, according to claim 10, wherein the upper base has a diameter greater than the perimeter wall of the upper part.

15. The cap for containers, according to claim 10, wherein the lower part comprises a third perimeter relief on its inner face disposed on a plane below the cut-out and extending at least between the ends of said cut-out.

16. The cap for containers, according to claim 10, wherein the upper base comprises a cylindrical skirt that emerges from its inner face and is dimensioned so as to be inserted in the interior of the neck of the container.

17. The cap for containers, according to claim 12, wherein the upper base has a diameter greater than the perimeter wall of the upper part.

18. The cap for containers, according to claim 12, wherein the lower part comprises a third perimeter relief on its inner face disposed on a plane below the cut-out and extending at least between the ends of said cut-out.

19. The cap for containers, according to claim 12, wherein the upper base comprises a cylindrical skirt that emerges from its inner face and is dimensioned so as to be inserted in the interior of the neck of the container.

* * * * *